US005320084A

United States Patent [19]

Rabska

[11] Patent Number: 5,320,084

[45] Date of Patent: Jun. 14, 1994

[54] STRING/BOW LIMB ATTACHMENT FOR AN ARCHERY BOW

[75] Inventor: Don S. Rabska, Los Angeles, Calif.

[73] Assignee: Easton Aluminum, Inc., Van Nuys, Calif.

[21] Appl. No.: 990,603

[22] Filed: Dec. 14, 1992

[51] Int. Cl.[5] ..... F41B 5/00

[52] U.S. Cl. ..... 124/23.1

[58] Field of Search ..... 124/23.1

[56] References Cited

U.S. PATENT DOCUMENTS

| | | | |
|---|---|---|---|
| 213,851 | 4/1879 | Streeter | 124/23.1 |
| 2,758,587 | 8/1956 | Verreau | 124/23.1 |
| 2,836,165 | 5/1958 | Bear | 124/23.1 |
| 2,836,166 | 5/1958 | Bear | 124/23.1 |
| 2,844,136 | 7/1958 | Folberth | 124/23.1 |
| 4,819,608 | 4/1989 | Filice | 124/23.1 |

FOREIGN PATENT DOCUMENTS

| | | | |
|---|---|---|---|
| 833195 | 10/1938 | France | 124/23.1 |

*Primary Examiner*—Randolph A. Reese
*Assistant Examiner*—Anthony Knight
*Attorney, Agent, or Firm*—Roth & Goldman

[57] ABSTRACT

An improved groove construction for attaching a bowstring to the limb tips of an archery bow such as a longbow or a recurve bow (10) places the string (16) in a special groove (38) at the extreme ends of the limb tips thus increasing the operative bow limb length and results in increase in arrow velocities of from 2 to 3 percent. The "Y" in the string loops at the tip attachments faces away from the archer and the bights in the string loops face toward the archer thus assisting in bending the extreme limb tips as the string is drawn to make the limb tips functional in propelling the arrow.

8 Claims, 2 Drawing Sheets

FIG. 1A
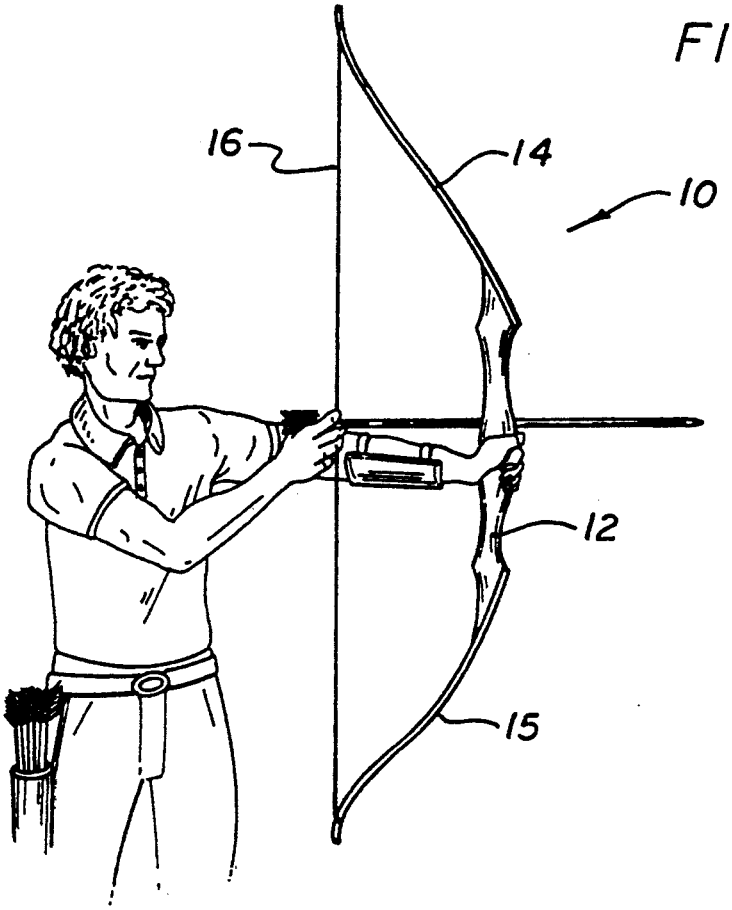
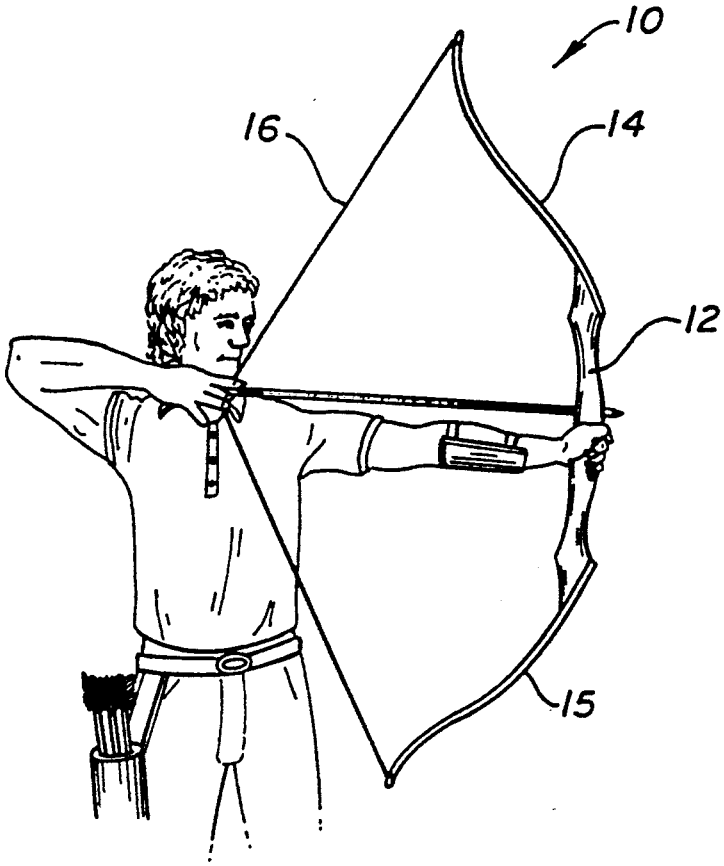
FIG. 1B

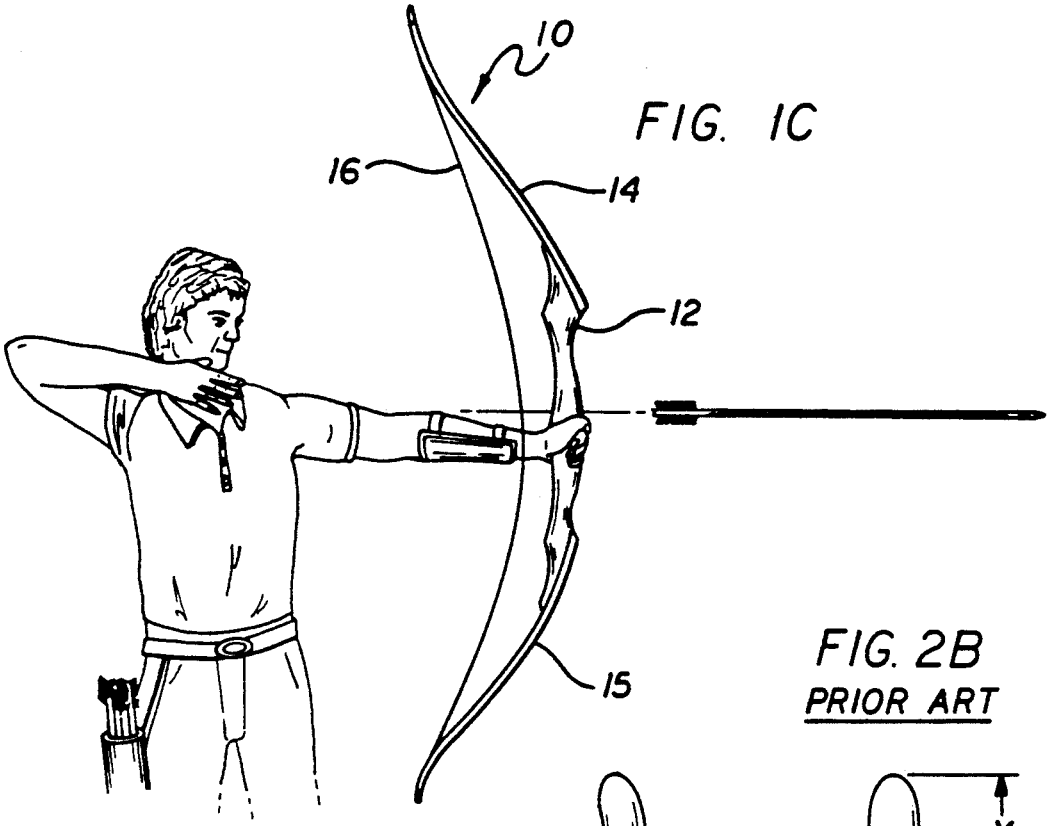
FIG. 1C
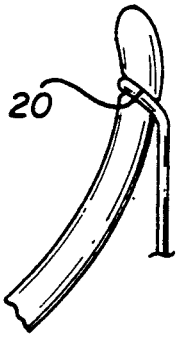
FIG. 2A
PRIOR ART
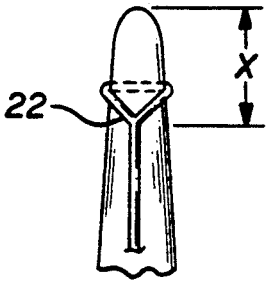
FIG. 2B
PRIOR ART
FIG. 3A
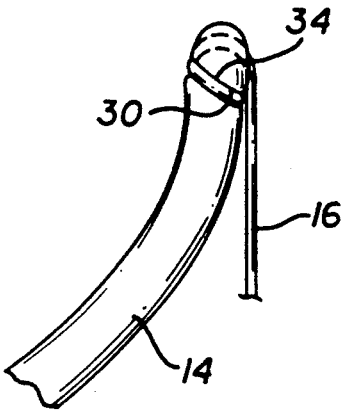
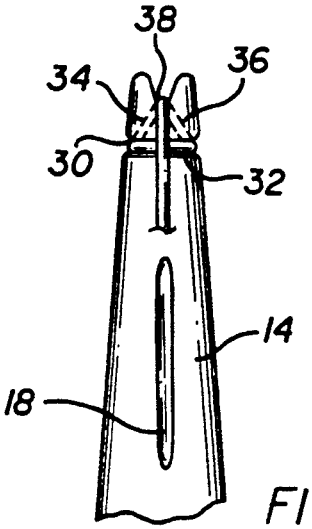
FIG. 3B
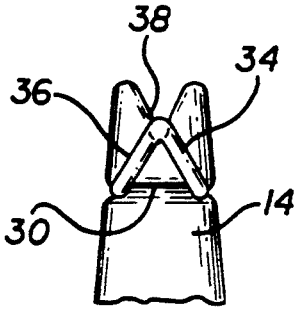
FIG. 4

STRING/BOW LIMB ATTACHMENT FOR AN ARCHERY BOW

BACKGROUND OF THE INVENTION

1. Field of the Invention

This invention relates in general to archery and, more particularly, to the manner in which a bowstring is attached to the limb tips of a longbow or a recurve bow.

2. Prior Art

Conventional recurve bows have a handle and a pair of limbs which may be constructed either integrally with the bow handle or as separate parts attachable to the handle. The term "recurve bow" refers to bows which have a main curvature which is convex away from the archer and a pair of end curves which are convex toward the archer until the bow is drawn at which time the end curves change their configuration, i.e. "recurve" to follow the curvature of the main bow curvature. As the bowstring is released, the bowstring propels the arrow forwardly at a first rate of acceleration until the bowstring contacts the bow limbs after the end curves have returned to their original shape at which time the arrow is propelled at a second higher rate of acceleration due to the shortened free length of bowstring. In high level world class target recurve bow archery events, arrows leave the bow at speeds in excess of 200 feet per second. The speed is a direct function of a number of factors including the free bowstring length, i.e., the distance between points of contact of the string with the bow. Even slight increases in arrow speed translate to improved accuracy in target shooting.

It is therefore the main objective of the present invention to increase the speed at which arrows are propelled by a longbow or a recurve bow without altering the bow dimensions or draw weight.

SUMMARY OF THE INVENTION

The present invention comprises a bow having a bowtip construction wherein each tip has a bowstring receiving groove which bifurcates the tip. The tip construction can be used with longbows or with the limbs of recurve bows.

BRIEF DESCRIPTION OF THE DRAWINGS

FIGS. 1A-1C respectively show side views of a recurve bow in a strung but undrawn configuration; in a configuration when drawn to its full draw length in preparation for shooting; and in a released configuration during shooting after release of the bowstring where the bowstring has contacted the recurve limbs.

FIG. 2A is a side view to an enlarged scale of a conventional connection of bowstring to limb tip and FIG. 2B is a front view (from the archer's side) of the limb tip seen in FIG. 2A.

FIG. 3A is a side view and FIG. 3B is a front view (from the archer's side) of the bow limb tip of the present invention.

FIG. 4 is a rear view of the bow limb tip of FIG. 3B.

DESCRIPTION OF THE PREFERRED EMBODIMENTS

As seen in FIG. 1A, a recurve bow 10 has a handle section 12 and a pair of either integrally formed or separately removable limbs 14, 15 which each have a slight "S" configuration when the limbs are attached to the handle 12 and the bowstring 16 is strung from limb tip to limb tip. Note particularly that the bowstring 16 contacts the forward side (archer's side) of the end recurves of the bow limbs. A centered groove 18 (FIG. 3B may be provided on the archer's side of the limb tips in the area where the string 16 contacts the recurve portions of the limbs 14, 15. As the bow is drawn to its full draw length as seen in FIG. 1B, the limb end curves substantially straighten and are no longer in contact with the bowstring 16. During shooting when the arrow is propelled by the bowstring as seen in FIG. 1C, the bowstring 16 during its forward motion contacts the archer's side of the recurve limbs 14, 15 thus shortening its free or effective length and propelling the arrow forward with increased velocity.

FIGS. 2A and 2B respectively show side and front views of the conventional string/limb tip attachment in which the limb tip is provided with a peripherally extending string attachment groove 20, and the string has a loop at the end formed by weaving or splicing. The "Y" 22 in the groove 20 is on the side of the limb tips facing the archer and is spaced a certain minimum but finite distance X from the extreme limb tip.

In comparison, the bowstring/limb tip attachment of the present invention as seen in FIGS. 3A and 3B comprises a peripheral groove 30 having a first transversely extending horizontal portion 32 on the front side of the limb 14 near the tip thereof which merges with a pair of upwardly extending groove portions 34, 36 which join on the rear side of the limbs 14, 15 and continue toward the limb tips along the longitudinal centerline of the limbs 14, 15 to a third groove portion 38 which bifurcates the limb at the extreme tip end thereof. When the loop of string is placed into the limb tip design of the present invention, the bight in the string loop is in the groove portion 32 facing the archer and the "Y" in the bowstring is on the side of the limb tip away from the archer whereby the operating portion of the string on the archer's side of the bow 10 is thus able to extend substantially from the extreme limb tip of the bow to the opposite limb tip rather than being spaced therefrom by the distance X as seen in the typical prior art arrangements shown in FIG. 2. This string groove configuration has the effect of increasing the operative length of the flexible bow limbs 14, 15 bringing the previously unused extreme tip portions thereof into play by allowing the string to exert a bending moment on the tips. The operative bow length is thus increased by a distance 2X.

Tests have been made which have surprisingly revealed that the limb tip design of FIG. 3 results in an increase of the order of from 2-3 percent in the arrow speed—i.e. from about 205 feet per second to about 210 feet per second. The increased arrow velocity is attributable to the extra operative limb length as seen in FIG. 1B as compared with typical prior art bow limb tip string attachments.

Persons skilled in the art will readily appreciate that various modifications can be made from the preferred embodiment thus the scope of protection is intended to be defined only by the limitations of the appended claims in which reference numerals have been included merely for explanation rather than limitation.

I claim:

1. An archery bow having a bowtip construction wherein each tip has a bowstring receiving groove which bifurcates the tip and said tip having a transversely extending string groove portion on the side facing the archer for receiving a bowstring coextensively within said groove, said transversely extending string groove portion extending continuously around the bow tip and opposite ends of the groove portion merge with said groove which bifurcates said tip to form a Y on the side opposite said archer.

2. A bow according to claim 1, further comprising a centered longitudinally extending string contact groove in said bow on the side facing said archer to receive said bowstring.

3. A limb for a recurve bow, said limb having a limb tip and a bowstring receiving groove therein which bifurcates the tip of said limb, said tip having a transversely extending string groove portion on the side facing the archer for receiving a bowstring coextensively within said groove, said transversely extending string groove portion extending continuously around the bow tip and opposite ends of the groove portion merge with said groove which bifurcates said tip to form a Y on the side opposite said archer.

4. A limb according to claim 3, further comprising a centered longitudinally extending string contact groove in said recurve portion on the side facing said archer to receive said bowstring.

5. A recurve bow having a handle and a pair of recurve bow limbs, each limb having a limb tip and a bowstring receiving groove therein which bifurcates the tip of said limb, said tips each having a transversely extending string groove on the side facing the archer for receiving a bowstring coextensively within said groove, said transversely extending string groove portion extending continuously around the bow tip and opposite ends of the groove portion merge with said groove which bifurcates said tip to form a Y on the side opposite said archer.

6. A bow according to claim 5, further comprising a centered longitudinally extending string contact groove in each of said recurve portions on the side facing said archer to receive said bowstring.

7. A bow according to claim 6, wherein said limbs are removably attached to said handle.

8. A bow according to claim 6, wherein said limbs and handle are integral.

* * * * *